US006123189A

United States Patent [19]

Falkenberg et al.

[11] Patent Number: 6,123,189

[45] Date of Patent: Sep. 26, 2000

[54] IN-CONTAINER SACHET

[75] Inventors: Robert J. Falkenberg, Alpharetta, Ga.; Georg Troska, Herten, Germany

[73] Assignee: The Coca-Cola Company, Atlanta, Ga.

[21] Appl. No.: 09/097,434

[22] Filed: Jun. 15, 1998

[51] Int. Cl.[7] ..... B65D 85/72

[52] U.S. Cl. ..... 206/217; 426/112; 53/471

[58] Field of Search ..... 206/205, 216, 206/217, 219, 457, 459.5; 53/474, 471; 426/112

[56] References Cited

U.S. PATENT DOCUMENTS

| | | | |
|---|---|---|---|
| 4,399,158 | 8/1983 | Bardsley et al. | 206/217 |
| 4,518,082 | 5/1985 | Ye | 206/217 |
| 4,911,320 | 3/1990 | Howes | 220/20 |
| 4,930,652 | 6/1990 | Murphy et al. | 220/90.2 |
| 5,046,631 | 9/1991 | Goodman | 220/85 R |
| 5,056,659 | 10/1991 | Howes et al. | 206/217 |
| 5,056,681 | 10/1991 | Howes | 220/522 |
| 5,080,247 | 1/1992 | Murphy et al. | 220/706 |
| 5,099,232 | 3/1992 | Howes | 340/815.21 |
| 5,244,112 | 9/1993 | Murphy et al. | 220/706 |
| 5,283,567 | 2/1994 | Howes | 340/815.69 |
| 5,482,158 | 1/1996 | Plester | 206/217 |
| 5,524,788 | 6/1996 | Plester | 220/522 |
| 5,547,103 | 8/1996 | Murphy et al. | 220/709 |
| 5,728,415 | 3/1998 | Troska | 206/217 |
| 5,827,555 | 10/1998 | Thorne et al. | 426/112 |
| 5,899,351 | 5/1999 | Murphy et al. | 206/217 |

FOREIGN PATENT DOCUMENTS

| | | |
|---|---|---|
| 94 12 713 | 9/1994 | Germany . |
| WO 95/00414 | 1/1995 | WIPO . |
| WO 97/21613 | 6/1997 | WIPO . |

*Primary Examiner*—Jim Foster
*Attorney, Agent, or Firm*—Jones & Askew LLP

[57] ABSTRACT

A sachet for insertion into a beverage container prior to the sealing and pressurization of the beverage container. The sachet is made from a gas permeable and substantially liquid impermeable material. The article is positioned within this material and sealed with substantially no excess gas contained therein. The sachet sinks when dropped into the beverage container and subsequently floats after the container is sealed and pressurized as gas from within the container penetrates into the sachet until equilibrium is reached. The sachet then rises within the beverage container when the container is opened.

18 Claims, 2 Drawing Sheets

IN-CONTAINER SACHET

TECHNICAL FIELD

The present invention relates generally to a sachet for insertion in a beverage container, and more particularly relates to an air permeable sachet for delivering an article in a beverage can.

BACKGROUND OF THE INVENTION

The packaging for food and beverages often includes promotional material such as coupons and various types of advertisements. Dry goods such as cereal often include a coupon or some sort of promotional prize within the packaging itself. This type of in-package promotion is also known with beverages, although there are additional concerns with beverages because of possible contamination by the promotion and also with the safe delivery of the promotion to the consumer. As a result, most in-container beverage promotions focus on a "under the cap" approach, such as that described in commonly-owned U.S. Pat. No. 5,524,788 to Plester entitled "Closure With Hidden-Gift Compartment."

Known in-container beverage promotions have generally used mechanical delivery systems for holding the promotion, prize, or other article within the container in proper orientation with the container opening. For example, International Application No. PCT/GB94/01310 to Benge, et al. describes a container having a lid made from a metal/polymer laminate. This lid has a fixedly-attached polymer guide tube positioned underneath the pop-top. A prize sachet is positioned within the guide tube. The lid, including the guide tube and the prize sachet, is then inserted into the beverage can and the can is sealed. When the consumer opens the can, the prize sachet is described as floating to the surface in the guide tube on its own or with the aid of a buoyant material such as cork or expanded polystyrene. The prize sachet itself is described as made from a foil material or other material that prevents the ingress of liquid or moisture.

A more complex design is shown in U.S. Pat. No. 5,056,659 to Howes, et al. Howes describes a sealed prize compartment separated from the lower part of the container. The sealed guide tube is spring activated such that the prize is ejected when the consumer opens the can. U.S. Pat. No. 5,046,631 to Goodman also shows a spring activated guide tube. The guide tube is sealed to the lid of the can by an adhesive. Another delivery device is shown in commonly-owned U.S. Pat. No. 5,482,158 to Plester entitled "Promotional Device For Delivering A Prize From A Beverage Can."

Although all of these designs are adequate for the ultimate purpose of delivering a prize or promotion of some sort to the consumer from a beverage can, these designs suffer numerous drawbacks. For example, each of these disclosures involves a complex mechanical delivery system. Several of these references use springs or other types of "launch" systems. Compared to an ordinary beverage container, these mechanical delivery systems are expensive to manufacture and significantly slow down the beverage filling process.

Each of these references also requires the delivery system to be attached to the top lid of the can. The lid and the delivery system are then placed into the lower part of the can and then sealed. This type of container design, however, is not compatible with modern high-speed filling and sealing procedures. Modern manufacturing procedures involve manufacturing the lower part of the container, i.e., the bottom and the sidewalls, and a separate top lid for sealing the open container. In a manufacturing process known as "seaming", the open container is filled with the beverage and then the lid is passed just over the top of the container by a few millimeters and rolled into place. Because each of the disclosures referenced above has a delivery system attached to the top lid of the can, the system will not work with the horizontal sealing procedure, i.e., the lid and the attached delivery system cannot be positioned in the can with a single horizontal motion.

Attempts to accommodate this type of sealing procedure have used glues and mechanical seals to hold an article, such as a drinking straw, at the bottom of the can during the sealing process. For example, U.S. Pat. No. 4,930,652 to Murphy et al., discloses a soluble gelatin or binder to hold a straw in place during manufacture. The binder then dissolves into the beverage. Again, although this process may be acceptable for the ultimate goal of delivering an article in a beverage container to a consumer, the use of any type of soluble material is not favored given the possible affect the material may have on the taste of the beverage.

There is a need in the art, therefore, for a device and method for placing a prize sachet or other article into a beverage container. The device and method must be compatible with modern high speed beverage filing equipment and operations. Further, the device and method must not affect the taste or composition of the beverage.

SUMMARY OF THE INVENTION

The present invention provides a sachet for insertion into a beverage container prior to the sealing and pressurization of the beverage container. The sachet is made from a gas permeable and substantially liquid impermeable material. The article is positioned within this material and sealed with substantially no excess gas contained therein. The sachet sinks when dropped into the beverage container and subsequently floats after the container is sealed and pressurized as gas from within the container penetrates into the sachet until equilibrium is reached. The sachet then rises within the beverage container when the container is opened.

Specific embodiments of the invention include the use of a thermoplastic material as the gas permeable and substantially liquid impermeable material. This material may be a thermoplastic, including ethylene copolymers such as polypropylene and polyethylene; polycarbonate; polyesters such as PET (polyethylene terephthalate); nylons; or any type of conventional plastic material. The specific gravity of the material, with fillers, is generally greater than about 1.0 with a carbon dioxide permeation rate of about 20 cc.-mil./100 sq.in.-day-atm. or more. The material is generally in the form of a thin film. The article sealed within the sachet remains substantially dry while gases from within the pressurized beverage container penetrate into the sachet.

The sachet may be positioned within a hollow tube such that the sachet remains intact as the gases from within the pressurized beverage container penetrate into the sachet. The hollow tube is generally made of a thermoplastic material in a substantially rigid form. A float and a weight also may be positioned about the hollow tube. The sachet is generally used within a beverage container having a cylindrical body and a lid with an orifice. The sachet may be positioned within the beverage container in a delivery tube positioned in the vicinity of said orifice.

The method of the present invention provides for delivering an article in a beverage container. The method includes the steps of sealing the article in a sachet that is gas permeable and substantially liquid impermeable, filling the beverage container with a carbonated beverage, dropping the sachet in the beverage container such that the sachet sinks or is suspended within the container, pressurizing the beverage container, penetrating the sachet with gases from the carbonated beverage until the pressure within the container and the sachet are at equilibrium, and opening the container such that the pressure within the container is released and the pressure within the sachet causes the sachet to rise within the container. The method may further include placing the sachet in a hollow tube such that the sachet substantially fills the hollow tube. The beverage container is sealed and pressurized by passing the top lid over the open end of the beverage container and seaming the top lid into place. Alternatively, the sachet may be placed in the beverage container after the container has been filled.

It is thus an object of the present invention to provide for a sachet that can be used with modern, high-speed filling equipment.

It is another object of the present invention to provide a sachet that sinks or is suspended when first placed in a beverage container and then absorbs gases from within the beverage container over a predetermined period of time such that the sachet floats when the container is opened.

It a further object of the present invention to provide a sachet that is gas permeable and substantially liquid impermeable.

It is a still further object of the present invention to provide an in-container sachet that delivers an article to the consumer without the use of a mechanical delivery device.

It is a still further object of the present invention to provide an in-container sachet that delivers an article to the consumer without the use of glues or other types of soluble binders.

Other objects, features and advantages of the present invention will become apparent upon reviewing the following description of preferred embodiments of the invention, when taken in conjunction with the drawings and the appended claims.

DETAILED DESCRIPTION OF THE INVENTION

Figure 1:
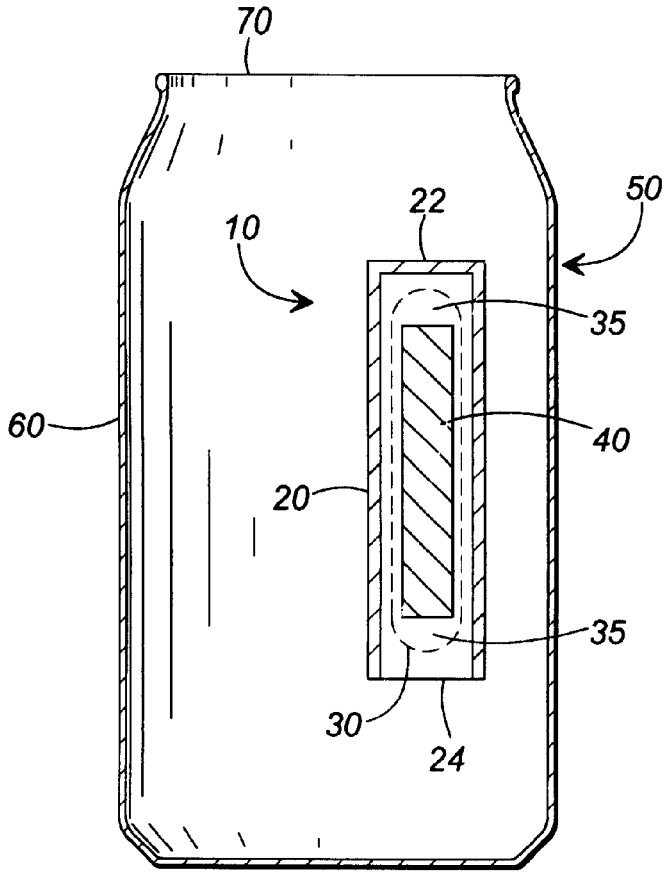
FIG. 1 a cross-sectional view of the delivery device within the container.
Figure 2:
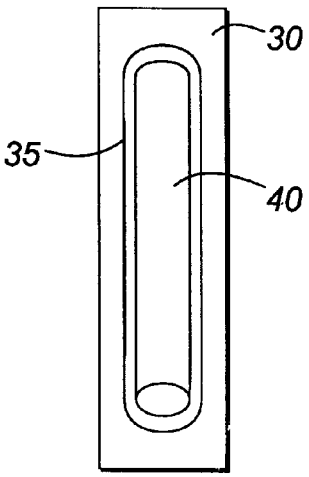
FIG. 2 is a plan view of the sachet.

Referring now in more detail to the drawings, in which like numerals refer to like parts throughout the several views, FIGS. 1 and 2 shows a delivery device 10 embodying the present invention. The delivery device 10 includes a prize tube 20, a sachet 30, and an article 40. The delivery device 10 is used with a conventional beverage container 50, such as an aluminum can.

The prize tube 20 is a substantially rigid, hollow tube with a first end 22 and a second end 24. Although the term tube 20 is used and preferred herein, it is understood that any shape may be used as the prize tube 20. The first end 22 may be closed, perforated, or open. The second end 24 is generally open. The prize tube 20 is made from a thermoplastic material including ethylene copolymers such as polypropylene and polyethylene; polycarbonates; polyesters such as PET (polyethylene terephthalate); nylons; or any type of conventional plastic material. The material must be acceptable for use with beverage containers on the basis of safety and taste. The specific gravity of the material should be at least about 1.0 and preferably equal to or greater than the specific gravity of the beverage (generally about 1.03 in the example of a soft drink) such that the prize tube 20, along with the sachet 30 and the article 40, will sink or at least be suspended within the container 50. If the material has a specific gravity of less than 1.0, for example polypropylene has a specific gravity of approximately 0.89, colorants or other additives can be added to the material to increase its specific gravity to acceptable levels.

Further, the specific gravity of the article 40 may have an impact on the selection of the materials. An article 40 with a relatively high specific gravity can be used with a prize tube 20 of a material with a relatively lower specific gravity. The weight of the article 40 also will have an impact on the overall buoyancy of the delivery device 10.

The sachet 30 is generally in the form of a sealed bag or other type of enclosure, such as a blister pack, a capsule, etc. The sachet 30 is made from a gas permeable, substantially liquid impermeable material. Examples for the sachet 30 material include the thermoplastic materials described above, generally in the form of a thin film. The material must be acceptable for use with beverage containers on the basis of safety and taste. The specific gravity of the sachet 30 material also should be more than about 1.0. As with the prize tube 20, the weight of the article 40 also will have an impact on the buoyancy of the sachet 30 and the delivery device 10 as a whole.

Figure 2A:
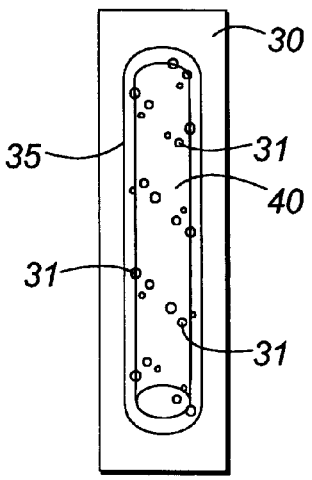
FIG. 2A is a plan view of the sachet with gas vents.

By the term "gas permeable", it is meant that the sachet 30 will permit gases contained in the beverage, such as carbon dioxide in the example of a carbonated soft drink, to permeate through the wall of the sachet 30 over a predetermined period of time, generally the amount of time it takes for the beverage to reach the consumer. For example, the carbon dioxide permeability rate for PET (polyethylene terephthalate) is generally about 20–40 cc-mil./100 sq.in.-day-atm at twenty-five (25) degrees Celsius while the carbon dioxide permeability rate for polypropylene is about 450–900 cc-mil./100 sq.in.-day-atm at the same temperature. The permeability rates of certain polyethylenes can be even higher. Alternatively, as is shown in FIG. 2A, gas vents 31 may be incorporated into the sachet material to increase the gas permeation rate. Likewise, by the term "substantially liquid impermeable", it is meant that the beverage will not penetrate through the sachet 30 material during a second predetermined period of time, generally substantially more than the expected shelf life of the beverage. For example, the water permeability rate for PET (polyethylene terephthalate) is generally about 4 gm.-mil./100 sq.in.-day-atm while the carbon dioxide permeability rate for polypropylene is about 0.7 gm.-mil./100 sq.in.-day-atm. The ambient temperature can have a significant impact on both gas and liquid permeability. The rate of permeability is increased as the temperature is increased.

The sachet 30 also must have sufficient burst strength such that the sachet material will remain intact both during permeation and when the equilibrium pressure outside the sachet 30 suddenly drops. The burst strength of the thermoplastics described above range from about 1200 pounds per square inch for certain types of polyethylene to 10,000 pounds per square inch or more for certain types of PET. In circumstances where there is no need to keep the article 40 dry, the sachet 30 need only be gas permeable, such that materials with relatively lower burst strengths can be used. The density of the prize tube 20 or the article 40, however, may need to be sufficient to keep the delivery device 10 floating after the sachet 30 bursts.

The article 40 may be a prize, a promotion, or other object such as a drinking straw. In FIG. 2, a tightly rolled bank note is shown as the article 40. The article 40 is sealed within the sachet 30 with as little void space 35 as possible to limit the amount of gas within the sachet 30 which may have an impact on its buoyancy. Alternatively, the article 40 can be sealed with a near vacuum. The use of such a vacuum may increase the permeability of gases into the sachet 30. The sachet 30 is sealed by conventional methods. For example, a linear low density heat seal may be used in the case of a sachet 30 made from a PET material. The strength of the seal should be relatively comparable to the strength of the material.

Figure 3:
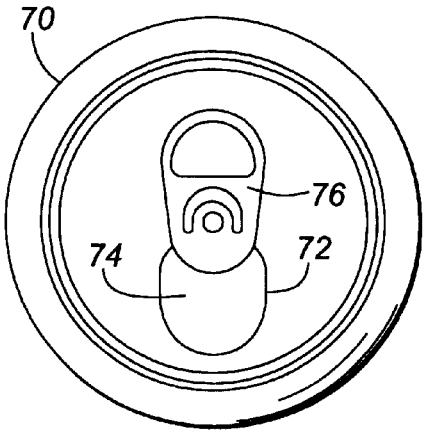
FIG. 3 is a plan view of the container lid.
Figure 4:
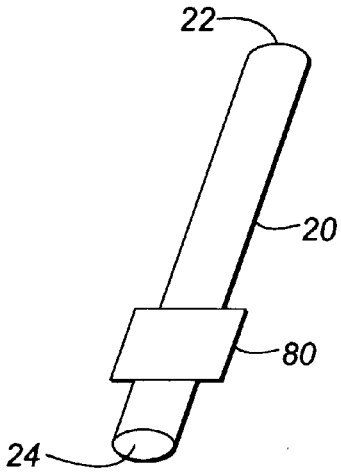
FIG. 4 is a plan view of the prize tube with the float.

As is shown in FIGS. 1 and 3, the container 50 is preferably a conventional aluminum can having a cylindrical body 60 and a top lid 70. The cylindrical body 60 and the top lid 70 are joined by the seaming operation described above. The container 50 is usually, but not necessarily, filled with a beverage, such as a carbonated soft drink or other type of beverage, before the seaming process. The top lid 70 has a substantially circular or oval orifice 72 therein for pouring the beverage out of the container 50. The orifice 72 is sealed by a closure tab 74. As is well known, the closure tab 74 is opened by a lever ring 76 positioned on top of the lid 70 adjacent to the closure tab 74. The delivery device 10 also can be used with any other type of conventional beverage container such as glass, plastic, or laminate bottles or cartons. FIG. 4 shows a further embodiment of the delivery system 10. In this embodiment, a float 80 is attached to the prize tube 20. The float 80 surrounds or is attached to the prize tube 20 at one end, substantially adjacent to the second end 24. The float 80 is preferably made from the same material as the sachet 30 or from conventional types of buoyant material such as a closed cell foam. The float 80 may be used increase the buoyancy of the delivery device 10, i.e., the combination of the prize tube 20, the sachet 30, and the article 40.

Figure 5:
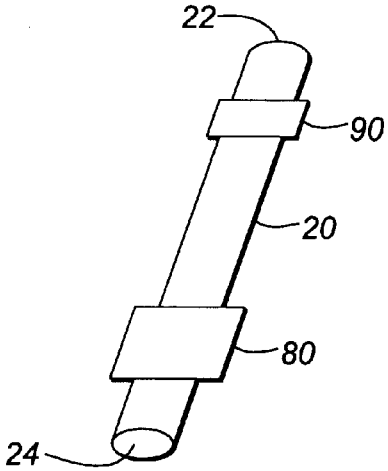
FIG. 5 is a plan view of the prize tube with the float and the weight.

FIG. 5 shows a further embodiment of the delivery device 10. This embodiment further includes a weight 90. The weight 90 can be made from the same material as the prize tube 20 or other conventional materials with a large enough specific gravity such that the material does not float in the beverage. The weight 90 also surrounds the prize tube 20, substantially adjacent to the first end 22 or adjacent to the float 80. The weight 90 may be used when the density of the delivery device 10, i.e., the combination of the prize tube 20, the sachet 30, the article 40, and the float 80 (if desired), is less than the density of the beverage before any gas has permeated into the sachet 30.

In use, the article 40 is sealed within the sachet 30 as described above. The sachet 30 is positioned within the prize tube 20. The sachet 30 substantially fills the tube 20, leaving little or no void space where trapped air may affect the buoyancy of the delivery device 10. The delivery device 10 is then dropped into the cylindrical body 60 of the container 50. The cylindrical body 60 preferably is filled with the beverage prior to the insertion of the delivery device 10. Alternatively, the delivery device 10 may be inserted into the cylindrical body 60 of the container 50 prior to filling depending upon the nature of the filling system.

Because the sachet 30 and the prize tube 20 have few or no internal voids 35 for the collection of gases and because the density or the weight of the delivery device 10 is more than the density of the beverage, the delivery device 10 sinks or is suspended within the container 50. By use of the term "sink" or "sinks", it is meant that the delivery device 10 does not float to the top of the container 50, i.e. the delivery device 10 may sink or be suspended. Because the delivery device 10 does not float to the top of the cylindrical body 60 of the container 50, the cylindrical body 60 and the lid 70 can be joined in the conventional high speed seaming process described above. The lid 70 is positioned horizontally over the cylindrical body 60 and joined without any obstruction caused by the delivery device 10 floating to the top of the cylindrical body 50 or otherwise interfering.

After the container 50 has been sealed, the container 50 generally is placed into normal distribution channels for ultimate delivery to the consumer. This process generally takes at least several days or weeks. During this time, the delivery device 10 will be subject to the internal pressure of the container 50.

For example, the container 50 is generally sealed at fifty-five (55) pounds per square inch of pressure with four (4) volumes of carbon dioxide in the case of a carbonated soft drink. Over time, the gas pressure within the container 50 will seek equilibrium with the partial pressure within the delivery device 10. Because the sachet 30 is made from a gas permeable material, carbon dioxide and other gases from within the container 50 will penetrate into the sachet 30 until the pressure within the sachet 30 reaches equilibrium. The sachet 30, any void spaces 35 within the sachet 30, and perhaps the article 40 itself will all absorb carbon dioxide and other gases until equilibrium with the internal pressure of the container 50 is reached.

The rate of diffusion of the carbon dioxide into the sachet 30 until equilibrium is reached, and hence the selection of the appropriate materials for the sachet 30, depends upon the normal distribution time and the normal sales velocity for the container 50. A longer distribution time will permit the use of a material with a lower diffusion rate. For example, a sachet 30 made from a thin film PET material will take about two (2) weeks to come to equilibrium. A polypropylene sachet 30 would have a faster diffusion rate while a nylon sachet 30 would be somewhat slower. The expected ambient temperature also must be considered. A higher temperature generally increases the diffusion rates.

When the consumer opens the container 50, the carbon dioxide and other gases within the container 50 rush out through the orifice 72 in the top lid 70 of the container 50. The pressure within the container 50 drops from its sealing pressure of, for example, fifty-five (55) pounds per square inch, to atmospheric pressure. The carbon dioxide and other gases within the sachet 30, however, cannot immediately evacuate the sachet 30 like the gases within the container 50. Rather, the gases remain trapped within the sachet 30 under pressure. This pressure differential causes the delivery device 10 to rise to the top of the container 50. One end of the delivery device 10 may extend out through the orifice 72 or the consumer may maneuver the delivery device 10 or the container 50 until the delivery device 10 extends through the orifice 72. The consumer then removes the delivery device 10 from the container 50. The consumer removes the sachet 30 from the prize tube 20, opens the sachet 30, and removes the article 40. The consumer may then consume the beverage.

Although the sachet 30 is described as being positioned within the prize tube 20, the use of the prize tube 20 is not required. The prize tube 20 generally ensures that the sachet 30 does not burst or inflate to the extent that the sachet 30 cannot be removed from the container 50 by the consumer. The prize tube 20 is not required to ensure that the sachet 30 first sinks, or at least is suspended, within the container 20 and then rises when the container 50 is opened. Likewise, the sachet 30 itself may be made from a rigid material similar to the prize tube 20. For example, the sachet 30 may be in the form of a rigid, substantially sealed polypropylene tube. Such a sachet 30 has excellent gas permeation rates, does not need a separate prize tube 20, but may be somewhat more difficult for the consumer to open.

The embodiments of FIGS. 4 and 5 provide for either additional lift, as in the case of the float 80, or less lift in the case of the weight 90. Depending upon the materials used for the prize tube 20, the sachet 30, and the article 40, various combinations of the float 80 and the weight 90 may be employed. The goal in determining the nature of the materials for the prize tube 20, the sachet 30 and the article 40, along with the decision on whether to use the float 80 and the weight 90, is to have the density of the delivery device 10 as a whole more than the density of the beverage when the device 10 is originally inserted into the container 50 such that the device 10 will sink or at least not float to the top of the container 50. Other considerations include the extent of the air content in the delivery device 10 that may impact upon its buoyancy.

Figure 6:
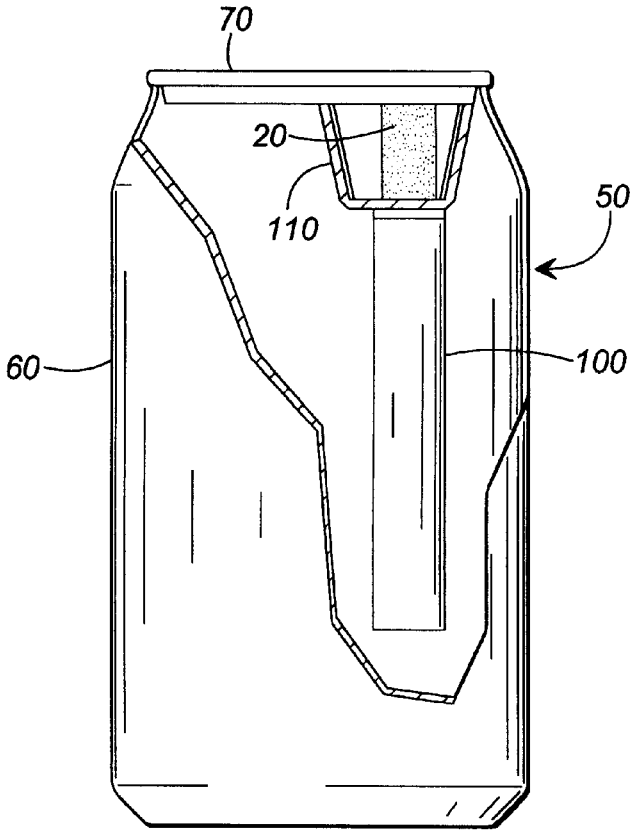
FIG. 6 is a cut-away view of the container showing the delivery device in the delivery tube.

As is shown in FIG. 6, the delivery device 10 also can be used with a delivery tube 100 or other type of delivery system. The delivery tube 100 can be any type of substantially rigid tube positioned to ensure that the sachet 30 floats to the top of the can 70 in the immediate vicinity of the orifice 72. For example, the delivery tube 100 can be attached via links 110 to the bottom of the container 50, to the cylindrical body 60, or around the top of the cylindrical body 60 in a conventional manner. The sachet 30 is dropped into position within the delivery tube 100 and the cylindrical body 60 is placed into the high speed seaming process as described above. Because the delivery device 10 sinks or is suspended within the cylindrical body 60, the cylindrical body 60 and the lid 70 can be joined without any interference.

The delivery device 10 also can be used with known delivery systems regardless of how the container 50 is sealed. The ability of the delivery device 10 to rise within the container 50 because of the pressure differentiation allows the delivery device 10 to replace known article containers. The speed and force with which the delivery device 10 rises within a container 50 ensures a dynamic and improved release of the article 40 regardless of how the delivery device 10 is positioned within the container 50.

The use of the gas permeable sachet 30 also can have applications outside the prize or promotion field. For example, the sachet 30 can enclose a drinking straw as the article 40. The drinking straw is sealed within the sachet 30 and then dropped into the container 50 as described above. Further, in the case of the drinking straw or similar objects, there is no need for the sachet 30 material to be substantially liquid impermeable. The penetration of liquid to the drinking straw or similar object will not have any impact on its use. Alternatively, the sachet 30 for an article 40 such as the drinking straw need not have the same burst strength as is required for the sachet 30 designed to keep the article 40 dry, depending upon the density of the article 40.

Further, the sachet 30 with relatively low burst strength also may be desired. The sachet 30 may enclose, for example, a fragrance intended to be released when the consumer opens the container 50. The material for the sachet 30 may have a low enough burst strength that the sachet 30 will rupture when the container 50 is opened, thereby giving the consumer an immediate burst of fragrance.

It should be understood that the foregoing relates only to preferred embodiments of the present invention, and that numerous changes may be made therein without departing from the spirit and scope of the invention as defined by the following claims.

I claim:

1. A delivery system for an article sealed within a pressurized beverage container, comprising:

a sachet;

said sachet comprising a gas permeable and substantially liquid impermeable material;

said article sealed within said sachet such that said article remains substantially dry while gases from within said pressurized beverage container penetrate into said sachet; and a hollow tube;

said sachet positioned within said hollow tube such that said sachet remains intact as said gases from within said pressurized beverage container penetrate into said sachet.

2. The delivery system of claim 1, wherein said gas permeable and substantially liquid impermeable material comprises a thermoplastic material.

3. The delivery system of claim 2, wherein said thermoplastic material comprises polypropylene.

4. The delivery system of claim 2, wherein said thermoplastic material comprises polyethylene.

5. The delivery system of claim 2, wherein said thermoplastic material comprises polyethylene terephthalate.

6. The delivery system of claim 1, wherein said gas permeable and substantially liquid impermeable material comprises a specific gravity greater than about 1.0.

7. The delivery system of claim 1, wherein said gas permeable and substantially liquid impermeable material comprises a thin film.

8. The delivery system of claim 1, wherein said hollow tube comprises a substantially rigid material.

9. The delivery system of claim 1, wherein said hollow tube comprises as thermoplastic material.

10. The delivery system of claim 1, further comprising a float positioned about said hollow tube.

11. The delivery system of claim 1, further comprising a weight positioned about said hollow tube.

12. The delivery system of claim 1, wherein said article comprises a bank note.

13. The delivery system of claim 1, further comprising a delivery tube positioned within said beverage container and wherein said hollow tube is positioned therein.

14. A beverage container with an internal sachet, comprising:

a cylindrical body;

a lid for sealing said cylindrical body;

said lid comprising an orifice;

a delivery tube positioned within said cylindrical body in the vicinity of said orifice; and said sachet positioned within said delivery tube;

said sachet comprising a gas permeable material with a specific gravity more than about 1.0 and a gas permeation rate of more than about 20 cc.-mil./100 sq.in-day-atm.

15. The beverage container of claim 14, wherein said sachet further comprises a substantially liquid impermeable material.

16. A method for delivering an article in a beverage container, comprising the steps of:

sealing said article in a sachet that is gas permeable and substantially liquid impermeable;

filling said beverage container with a carbonated beverage;

dropping said sachet in said beverage container such that said sachet sinks within said container;

pressurizing said beverage container;

penetrating said sachet with gases from said carbonated beverage until the pressure within said container and said sachet are at equilibrium; and opening said container such that said pressure within said container is released and said pressure within said sachet causes said sachet to rise within said container.

17. A method for delivering an article in a beverage container, comprising the steps of:

sealing said article in a sachet that is gas permeable and substantially liquid impermeable;

dropping said sachet in said beverage container;

filling said beverage container with a carbonated beverage;

pressurizing said beverage container;

penetrating said sachet with gases from said carbonated beverage until the pressure within said container and said sachet are at equilibrium; and opening said container such that said pressure within said container is released and said pressure within said sachet causes said sachet to rise within said container.

18. A method for delivering an article in a beverage container, comprising the steps of:

sealing said article in a sachet that is gas permeable and substantially liquid impermeable;

placing said sachet in a hollow tube such that said sachet substantially fills said hollow tube;

filling an open-ended beverage container with a carbonated beverage;

dropping said hollow tube, with said sachet therein, in said beverage container such that said hollow tube sinks within said container;

passing a top lid over said open end of said beverage container;

seaming said top lid into place such that said container is pressurized;

penetrating said sachet with gases from said carbonated beverage until the pressure within said container and said sachet are at equilibrium; and opening said container such that said pressure within said container is released and said pressure within said sachet causes said sachet to rise within said container.

* * * * *